US006245474B1

(12) United States Patent
Hsu et al.

(10) Patent No.: US 6,245,474 B1
(45) Date of Patent: Jun. 12, 2001

(54) POLYMER COATED CARRIER PARTICLES FOR ELECTROPHOTOGRAPHIC DEVELOPERS

(75) Inventors: George R. Hsu, Rochester; Scott M. Silence, Fairport; Lynne M. Tatar, Rochester; Bernard A. Kelly, Ontario; Pinyen Lin, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/520,446

(22) Filed: Mar. 7, 2000

(51) Int. Cl.[7] ..... G03G 9/10
(52) U.S. Cl. ..... 430/108; 430/137
(58) Field of Search ..... 430/108, 137

(56) References Cited

U.S. PATENT DOCUMENTS

| | | | |
|---|---|---|---|
| 3,590,000 | 6/1971 | Palermiti et al. | 252/62.1 |
| 4,233,387 | 11/1980 | Mammino et al. | 430/137 |
| 4,265,990 | 5/1981 | Stolka et al. | 430/59 |
| 4,298,672 | 11/1981 | Lu | 430/108 |
| 4,338,390 | 7/1982 | Lu | 430/106 |
| 4,368,970 | 1/1983 | Hays | 355/3 |
| 4,394,429 | 7/1983 | Hays | 430/102 |
| 4,935,326 | 6/1990 | Creatura et al. | 430/108 |
| 4,937,166 | 6/1990 | Creatura et al. | 430/108 |
| 5,567,562 | 10/1996 | Creatura et al. | 430/108 |
| 5,998,076 * | 12/1999 | Mahabadi et al. | 430/108 |

* cited by examiner

*Primary Examiner*—John Goodrow
(74) *Attorney, Agent, or Firm*—Oliff & Berridge, PLC; Eugene O. Palazzo

(57) ABSTRACT

A coated carrier having a core particle coated with a mixture of an electronegative insulating polymer comprising a polyvinylidenefluoride polymer or copolymer and an electropositive conductive polymer comprising a polymethyl methacrylate polymer or copolymer with a conductive material dispersed therein is made by powder coating. The coated carrier has unique properties, including a conductivity of from $1.1\times10^{-14}$ to $1.0\times10^{-8}$ mho-cm$^{-1}$, a triboelectric charging value of from 12 to 20 and an average particle diameter of from 65 to 75, rendering the coated carrier ideal for use in a developer to be used in a magnetic brush type development apparatus. The powder coating method includes mixing the core particle and the mixture of negatively charging polymer and conductive polymer until the mixture of negatively charging polymer and conductive polymer adheres to the core particle, heating the mixture of the core particle and the mixture of negatively charging polymer and conductive polymer until the mixture of negatively charging polymer and conductive polymer melts and fuses to the core particle, and cooling the coated core obtained.

15 Claims, No Drawings

POLYMER COATED CARRIER PARTICLES FOR ELECTROPHOTOGRAPHIC DEVELOPERS

BACKGROUND OF THE INVENTION

1. Field of Invention

This invention relates to polymer coated carrier particles for electrophotographic developers, a method of making the same by dry powder coating, and developers containing the coated carrier particles.

2. Description of Related Art

The electrostatographic process, and particularly the xerographic process, is well known. This process involves the formation of an electrostatic latent image on a photoreceptor, followed by development of the image with a developer, and subsequent transfer of the image to a suitable substrate. Numerous different types of xerographic imaging processes are known wherein, for example, insulative developer particles or conductive developer particles are selected depending on the development systems used. Moreover, of importance with respect to the aforementioned developer compositions is the appropriate triboelectric charging values associated therewith, as it is these values that enable continued constant developed images of high quality and excellent resolution.

Various coated carrier particles for use in electrostatographic developers are known in the art. Carrier particles for use in the development of electrostatic latent images are described in many patents including, for example U.S. Pat. No. 3,590,000. These carrier particles may consist of various cores, including steel, with a coating thereover of fluoropolymers; and terpolymers of styrene, methacrylate, and silane compounds. Recent efforts have focused on the attainment of coatings for carrier particles, for the purpose of improving development quality; and also to permit particles that can be recycled, and that do not adversely affect the imaging member in any substantial manner. Many of the present commercial coatings can deteriorate rapidly, especially when selected for a continuous xerographic process where the entire coating may separate from the carrier core in the form of chips or flakes; and fail upon impact, or abrasive contact with machine parts and other carrier particles. These flakes or chips, which cannot generally be reclaimed from the developer mixture, have an adverse effect on the triboelectric charging characteristics of the carrier particles thereby providing images with lower resolution in comparison to those compositions wherein the carrier coatings are retained on the surface of the core substrate. Further, another problem encountered with some prior art carrier coatings resides in fluctuating triboelectric charging characteristics, particularly with changes in relative humidity. The aforementioned modification in triboelectric charging characteristics provides developed images of lower quality, and with background deposits.

There is also illustrated in U.S. Pat. No. 4,233,387 coated carrier components for electrostatographic developer mixtures comprised of finely divided toner particles clinging to the surface of the carrier particles. Specifically, there is disclosed in this patent coated carrier particles obtained by mixing carrier core particles of an average diameter of from between about 30 microns to about 1,000 microns, with from about 0.05 percent to about 3.0 percent by weight, based on the weight of the coated carrier particles, of thermoplastic resin particles. The resulting mixture is then dry blended until the thermoplastic resin particles adhere to the carrier core by mechanical impaction, and/or electrostatic attraction. Thereafter, the mixture is heated to a temperature of from about 320° F. to about 650° F. for a period of 20 minutes to about 120 minutes, enabling the thermoplastic resin particles to melt and fuse on the carrier core. While the developer and carrier particles prepared in accordance with the process of this patent, the disclosure of which is incorporated herein by reference in its entirety, are suitable for their intended purposes, the conductivity values of the resulting particles are not constant in all instances, for example, when a change in carrier coating weight is accomplished to achieve a modification of the triboelectric charging characteristics; and further with regard to U.S. Pat. No. 4,233,387, in many situations carrier and developer mixtures with only specific triboelectric charging values can be generated when certain conductivity values or characteristics are contemplated.

U.S. Pat. No. 4,937,166, incorporated by reference herein in its entirety, describes a carrier composition comprised of a core with a coating thereover comprised of a mixture of first and second polymers that are not in close proximity thereto in the triboelectric series. The core is described to be iron, ferrites, steel or nickel. The first and second polymers are selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and polystyrene; and polyvinyl acetate and polymethyl methacrylate. The particles are described to have a triboelectric charging value of from about −5 to about −80 microcoulombs per gram.

U.S. Pat. No. 4,935,326, incorporated by reference herein in its entirety, discloses a carrier and developer composition, and a process for the preparation of carrier particles with substantially stable conductivity parameters which comprises (1) providing carrier cores and a polymer mixture; (2) dry mixing the cores and the polymer mixture; (3) heating the carrier core particles and polymer mixture, whereby the polymer mixture melts and fuses to the carrier core particles; and (4) thereafter cooling the resulting coated carrier particles. These particulate carriers for electrophotographic toners are described to be comprised of core particles with a coating thereover comprised of a fused film of a mixture of first and second polymers which are not in close proximity in the triboelectric series, the mixture being selected from the group consisting of polyvinylidenefluoride and polyethylene; polymethyl methacrylate and copolyethylene vinyl acetate; copolyvinylidenefluoride tetrafluoroethylene and polyethylenes; copolyvinylidenefluoride tetrafluoroethylene and copolyethylene vinyl acetate; and polymethyl methacrylate and polyvinylidenefluoride.

U.S. Pat. No. 5,567,562, incorporated by reference herein in its entirety, describes a process for the preparation of conductive carrier particles which comprises mixing a carrier core with a first polymer pair and a second polymer pair, heating the mixture, and cooling the mixture, wherein the first and second polymer pair each contain an insulating polymer and a conductive polymer and wherein the carrier conductivity thereof is from about $10^{-6}$ to about $10^{-14}$ $(\text{ohm-cm})^{-1}$. The first polymer pair is preferably comprised of an insulating polymethyl methacrylate and a conductive polymethyl methacrylate, and the second polymer pair is preferably comprised of an insulating polyvinylidenefluoride and a conductive polyvinylidenefluoride.

In addition, Hewlett Packard sells a developer containing a coated carrier for use in its HP D640 printer, which coated carrier is believed to be comprised of a magnetite core solution coated with a conductive polymer of polymethyl methacrylate containing carbon black, although the carrier formulation is proprietary to Hewlett Packard and cannot be determined with certainty. Typically, however, carriers obtained by applying insulating resinous coatings to porous metallic carrier cores using solution coating techniques are undesirable from many viewpoints. For example, the coating material will usually reside in the pores of the carrier cores, rather than at the surfaces thereof, and therefore is not available for triboelectric charging when the coated carrier particles are mixed with finely divided toner particles. Attempts to resolve this problem by increasing the carrier coating weights, for example, to as much as 3 percent or greater to provide an effective triboelectric coating to the carrier particles necessarily involves handling excessive quantities of solvents, and further usually these processes result in low product yields. Also, solution coated carrier particles when combined and mixed with finely divided toner particles provide in some instances triboelectric charging values which are too low for many uses.

SUMMARY OF THE INVENTION

It is an object of the invention to develop a coated carrier possessing excellent properties for use in developer compositions. It is another object of the present invention to develop an efficient and reliable method of making such coated carrier.

These and other objects of the present invention are achieved herein. The present invention relates to a coated carrier composition, method of making the same and developer composition containing the same in which the coated carrier composition comprises a magnetite core powder coated with both (1) an electropositive conductive polymer or copolymer of polymethyl methacrylate (PMMA) having carbon black dispersed therein, and (2) an electronegative insulating polymer of polyvinylidenefluoride.

The invention also relates to a method of making the coated carrier by powder coating.

The coated carrier composition prepared by powder coating of this invention has excellent and unique properties ideally suited for particular use in a developer for an electrostatographic printing device in which development of latent images is effected utilizing a magnetic brush.

DETAILED DESCRIPTION OF PREFERRED EMBODIMENTS

The carrier of the present invention comprises core particles coated thereover with a mixture of at least two dry polymer components, which dry polymer components preferably have different polarities and are of opposite conductivities, i.e., one of the polymer is conductive and the other is insulative.

As the core particle, various suitable solid core carrier materials may be selected. The core preferably should possess properties that will enable the toner particles to acquire a positive charge or a negative charge, and that will permit desirable flow properties in the developer reservoir present in the xerographic imaging apparatus. Also of value with regard to the carrier core properties are, for example, suitable magnetic characteristics that will permit magnetic brush formation in mag brush development processes. The core should also preferably possess desirable mechanical aging characteristics.

Examples of carrier cores that may be selected include iron, steel, ferrites, magnetites, nickel, and mixtures thereof. Most preferably, the carrier cores are magnetite. The core particles, in particular magnetite core particles, preferably have an average particle diameter of from 50 to 80 microns, more preferably 60 to 70 microns, most preferably 65 microns as determined by standard laser diffraction techniques, a magnetic saturation of 80 to 110 emu/g, more preferably 85 to 95 emu/g, most preferably 91 emu/g, a coercivity of 20 to 30 Oer, more preferably 22 to 25 Oer, most preferably 24 Oer, and a retentivity of 1.0 to 5.0 emu/g, more preferably 2.0 to 3.0 emu/g, most preferably 2.5 emu/g. In addition the magnetite core particles have a powder density as determined by ASTM Test B-212-99 of 2.35 to 2.75 g/cm$^3$, preferably 2.45 to 2.65 g/cm$^3$, most preferably 2.55 g/cm$^3$, a conductivity of $1.5\times10^{-7}$ to $1.5\times10^{-9}$ (ohm cm)$^{-1}$, most preferably $1.5\times10^{-8}$ (ohm cm)$^{-1}$ and a breakdown voltage of 30 to 50 V, most preferably 45V. The conductivity of the core is measured by applying a 10 V fixed voltage across a 0.1 inch magnetic brush in a static (non-rotating) mode. The resultant current flow through the material is used to calculate the conductivity of the core. The voltage breakdown of the core is measured by applying a fixed rate of increasing voltage across 0.1 inch magnetic brush while under rotation. The applied voltage at which 100 microamps of current flows through the samples is defined as the breakdown voltage.

The carrier cores are coated with a mixture of dry polymers of different polarities two of which are preferably not in close proximity thereto in the triboelectric series, and at least one of which is a conductive polymer and at least another one of which insulative.

In the invention, the electronegative polymer that will generally impart a positive charge on the toner which it is contacted with, is preferably comprised of a polyvinylidenefluoride polymer or copolymer. Such polyvinylidenefluoride polymers are commercially available, for example under the tradename Kynar from Pennwalt. Kynar 301F is polyvinylidenefluoride and Kynar 7201 is copolyvinylidenefluoride tetrafluoroethylene.

Also in the invention, the conductive polymer, that is also the electropositive polymer that will generally impart a negative charge on the toner which it is contacted with, is preferably comprised of a polymer or copolymer of polymethyl methacrylate (PMMA) having carbon black dispersed therein. PMMA by itself is an insulative polymer. To obtain the conductive polymer, the conductive component, here carbon black, is dispersed in the polymer. This dispersion may be accomplished by using a polymer powder in which carbon black is incorporated at a given level into each of the polymer particles, or alternatively the dispersion can be obtained by mixtures of polymer powders of similar chemistries, for example based on PMMA, in which only one of the powders contains carbon black.

The PMMA may be copolymerized with any desired comonomer, so long as the resulting copolymer retains an ability to have the carbon black dispersed therein and retains a suitable particle size. Suitable comonomers can include monoalkyl, or dialkyl amines, such as dimethylaminoethyl methacrylate, diethylaminoethyl methacrylate; and the like.

The PMMA polymer having carbon black therein is preferably formed in a semisuspension polymerization process, for example as described in U.S. Pat. No. 5,236,629, incorporated by reference herein in its entirety. The PMMA polymer which does not contain carbon black or any other conductive additive which is optionally mixed with the PMMA having carbon black dispersed therein, and which serves to alter the overall dispersion of the carbon black in the electropositive polymer, can be formed by a number of polymerization methods, including but not limited to suspension, semisuspension, or emulsion polymerization.

The PMMA conductive polymer preferably has a resistivity of less than 300 ohm-cms. For this, the carbon black is preferably contained in the polymer in an amount of, for example, 10 to 30% by weight of the polymer, more preferably 15 to 25% by weight, most preferably 17 to 21% by weight.

Also in the invention, another electropositive polymer, this one an insulative polymer, may be used to coat the core. This polymer is preferably comprised of a polymer or copolymer of polymethyl methacrylate (PMMA), The advantage of using a polyvinylidenefluoride as the electronegative polymer is that the tribo of the carrier can be controlled by adjusting the amount of polyvinylidenefluoride. The advantage of using a mixture of insulative and conductive electropositive PMMA powders in conjunction with the polyvinylidene fluoride is that separate adjustment of the ratio of the PMMA polymer with and without carbon black contained therein, but with the sum of the two polymers kept at a constant percentage of the resulting carrier particle, allows for independent adjustment of the electrical properties of the resultant carrier particles, that is, the carrier conductivity and voltage breakdown.

The percentage of each polymer present in the carrier coating mixture can vary depending on the specific components selected, the coating weight and the properties desired. In particular, the ratios of each of the aforementioned polymers can be varied to enable a specific conductivity, and the carrier tribo can be varied based on the ratio of electropositive to electronegative polymer components. Generally, the coated polymer mixtures used contain from about 10 to about 90 percent of the insulative polymer, and from about 90 to about 10 percent by weight of the conductive polymer. Preferably, there are selected mixtures of polymers with from about 10 to 40 percent by weight of the insulative polymer, and from about 60 to 90 percent by weight of the conductive polymer. Most preferably, there are selected mixtures of polymers with from about 10 to 30 percent by weight of the insulative polymer, and from about 70 to 90 percent by weight of the conductive polymer. Alternatively, to provide a more insulative carrier, the preferred ratio is about 5 to 25 percent by weight of the insulative electronegative polymer, and 75 to 95 percent by weight of the electropositive polymer which further comprises 0 to 65 percent by weight of PMMA and 35 to 100 percent by weight of PMMA with carbon black dispersed therein.

The carrier particles may be prepared by mixing the carrier core with from, for example, between about 0.05 to about 10 percent by weight, more preferably between about 0.05 percent and about 3 percent by weight, based on the weight of the coated carrier particles, of the mixture of dry polymers until adherence thereof to the carrier core by mechanical impaction and/or electrostatic attraction. The mixture of carrier core particles and polymers is then heated to a temperature of, for example, between from about 200° F. to about 650° F., preferably 320° F. to 550° F., most preferably 430° F. to 460° F., for a period of time of from, for example, about 10 minutes to about 60 minutes, enabling the polymers to melt and fuse to the carrier core particles. The coated carrier particles are then cooled and thereafter classified to a desired particle size. The coating preferably has a coating weight of from, for example, 0.1–3.0% by weight of the carrier, preferably 0.1–1.2% by weight.

Various effective suitable means can be used to apply the polymer mixture coatings to the surface of the carrier core particles. Examples of typical means for this purpose include combining the carrier core material and the mixture of polymers by cascade roll mixing, or tumbling, milling, shaking, electrostatic powder cloud spraying, fluidized bed, electrostatic disc processing, and an electrostatic curtain. Following application of the polymer mixture, heating is initiated to permit flowout of the coating material over the surface of the carrier core. The concentration of the coating material powder particles, as well as the parameters of the heating step, may be selected to enable the formation of a continuous film of the coating material on the surface of the carrier core, or permit only selected areas of the carrier core to be coated. When selected areas of the carrier core remain uncoated or exposed, the carrier particles will possess electrically conductive properties when the core material comprises a metal.

The coated carrier preferably possesses the following properties:

(1) a conductivity of from about $1.1\times10^{-14}$ to $1.0\times10^{-8}$ mho-cm$^{-1}$, more preferably $7.7\times10^{-9}$ mho-cm$^{-1}$, as measured, for example, across a 0.1 inch magnetic brush at an applied potential of 10 volts, and wherein the coating coverage encompasses from about 10 percent to about 100 percent of the carrier core;

(2) a triboelectric charging value of from about 12 to 20 microcoulombs per gram, more preferably 17, microcoulombs per gram on the carrier particles as determined by the known Faraday cage technique;

(3) an average particle diameter of from 65–75 microns, more preferably 70 microns, and a particle size distribution in which 90% of the particles have a diameter greater than 51 microns and 10% of the particles have a diameter greater than 98 microns as determined by standard laser diffraction techniques;

(4) a bulk density of 1.85–2.75 g/cm$^3$, more preferably 2.2 g/cm$^3$ as determined by ASTM Test B-212-89;

(5) a mass flow, as determined by ASTM Test B-213-97, of 1.25–1.85 g/sec, more preferably 1.45 g/sec; and (6) a breakdown voltage of 30–350 V, more preferably 50 V.

Developers incorporating the coated carriers of the present invention can be formulated with constant conductivity values with different triboelectric charging characteristics by, for example, maintaining the same coating weight on the carrier particles and changing the polymer coating ratios. Similarly, there can be formulated developer compositions wherein constant triboelectric charging values are achieved and the conductivities are altered by either adding an amount of insulative electropositive charging polymer to replace a percentage of the conductive electropositive charging polymer retaining the polymer ratio coating constant and modifying the coating weight for the carrier particles.

Subsequently, two component developer compositions of the present invention can be generated by admixing the carrier core particles with a toner composition comprised of resin particles and pigment particles. The toner concentration in the developer initially installed in a xerographic development housing is between 3.5 and 5 parts of toner per one hundred parts of carrier. Over the life of the developer, this concentration can vary from 3.5 to 9.0 parts of toner per one hundred parts of carrier with no significant impact on the copy quality of the resulting images. The developer composition preferably has a breakdown voltage of 200–1300 V, more preferably 1000 V.

Illustrative examples of finely divided toner resins selected for the developer compositions of the present invention include polyamides, epoxies, polyurethanes, diolefins, vinyl resins, styrene acrylates, styrene methacrylates, styrene butadienes, polyesters such as the polymeric esterification products of a dicarboxylic acid and a diol comprising a diphenol, crosslinked polyesters, and the like. Specific vinyl monomers include styrene, p-chlorostyrene vinyl naphthalene, unsaturated monoolefins such as ethylene, propylene, butylene and isobutylene; vinyl halides such as vinyl chloride, vinyl bromide, vinyl fluoride, vinyl acetate, vinyl propionate, vinyl benzoate, and vinyl butyrate; vinyl esters like the esters of monocarboxylic acids including methyl acrylate, ethyl acrylate, n-butyl-acrylate, isobutyl acrylate, dodecyl acrylate, n-octyl acrylate, 2-chloroethyl acrylate, phenyl acrylate, methylalphachloracrylate, methyl methacrylate, ethyl methacrylate, and butyl methacrylate; acrylonitrile, methacrylonitrile, acrylamide, vinyl ethers, inclusive of vinyl methyl ether, vinyl isobutyl ether, and vinyl ethyl ether; vinyl ketones inclusive of vinyl methyl ketone, vinyl hexyl ketone and methyl isopropenyl ketone; vinylidene halides such as vinylidene chloride and vinylidene chlorofluoride; N-vinyl indole, N-vinyl pyrrolidone; and the like. Also, there may be selected styrene butadiene copolymers, mixtures thereof, and the like.

As one toner resin there can be selected the esterification products of a dicarboxylic acid and a diol comprising a diphenol, reference U.S. Pat. No. 3,590,000, the disclosure of which is totally incorporated herein by reference. Other preferred toner resins include styrene/methacrylate copolymers; styrene/butadiene copolymers; polyester resins obtained from the reaction of bisphenol A and propylene oxide; and branched polyester resins resulting from the reaction of dimethyl terephthalate, 1,3-butanediol, 1,2-propanediol and pentaerythritol, and reactive extruded polyesters. Generally, from about 1 part to about 5 parts by weight of toner particles are mixed with from about 10 to about 300 parts by weight of the carrier particles of the present invention.

Numerous well known suitable pigments or dyes can be selected as the colorant for the toner particles including, for example, carbon black like REGAL 330, nigrosine dye, lamp black, iron oxides, magnetites, colored magnetites other than black, and mixtures thereof. The pigment, which is preferably carbon black, should be present in a sufficient amount to render the toner composition highly colored. Thus, the pigment particles can be present in amounts of from about 3 percent by weight to about 20 and preferably from 5 to about 15 percent by weight, based on the total weight of the toner composition, however, lesser or greater amounts of pigment particles may be selected in embodiments.

When the pigment particles are comprised of magnetites, which are a mixture of iron oxides (FeO, $Fe_2O_3$) including those commercially available as MAPICO BLACK, they are present in the toner composition in an amount of from about 10 percent by weight to about 70 percent by weight, and preferably in an amount of from about 20 percent by weight to about 50 percent by weight.

The resin particles are present in a sufficient, but effective amount, thus when 10 percent by weight of pigment, or colorant such as carbon black is contained therein, about 90 percent by weight of resin material is selected. Generally, however, the toner composition is comprised of from about 85 percent to about 97 percent by weight of toner resin particles, and from about 3 percent by weight to about 15 percent by weight of pigment particles such as carbon black.

Also encompassed within the scope of the present invention are colored toner and developer compositions comprised of toner resin particles, carrier particles, and as pigments or colorants, red, green, brown, blue, magenta, cyan and/or yellow particles, as well as mixtures thereof. More specifically, illustrative examples of magenta materials that may be selected as pigments include 1,9-dimethyl-substituted quinacridone and anthraquinone dye identified in the color index as CI 60720, CI Dispersed Red 15, a diazo dye identified in the color index as CI 26050, CI Solvent Red 19, and the like. Examples of cyan materials that may be used as pigments include copper tetra-4(octaecyl sulfonamido) phthalocyanine, X-copper phthalocyanine pigment listed in the color index as CI 74160, CI Pigment Blue, and Anthrathrene Blue, identified in the color index as CI 69810, Special Blue X-2137, and the like; while illustrative examples of yellow pigments that may be selected are diarylide yellow 3,3-dichlorobenzidene acetoacetanilides, a monoazo pigment identified in the color index as CI 12700, CI Solvent Yellow 16, a nitrophenyl amine sulfonamide identified in the color index as Foron Yellow SE/GLN, CI Dispersed Yellow 33, 2,5-dimethoxy-4-sulfonanilide phenylazo-4'-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

For further enhancing the positive charging characteristics of the developer compositions described herein, and as optional components there can be incorporated into the toner or on its surface charge enhancing additives inclusive of alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like and other similar known charge enhancing additives. Also, negative charge enhancing additives may also be selected, such as aluminum complexes, like BONTRON E-88, and the like. These additives are usually incorporated into the toner in an amount of from about 0.1 percent by weight to about 20 percent by weight, and preferably from 1 to about 3 percent by weight.

The toner composition of the present invention can be prepared by a number of known methods including melt blending the toner resin particles, and pigment particles or colorants followed by mechanical attrition. Other methods include those well known in the art such as spray drying, melt dispersion, dispersion polymerization, suspension polymerization, and extrusion. In one dispersion polymerization method, a solvent dispersion of the resin particles and the pigment particles is spray dried under controlled conditions to result in the desired product. Generally, the toners are prepared by mixing, followed by attrition, and classification to enable toner particles with an average volume diameter of from about 5 to about 20 microns.

Also, the toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules there can be selected the aryl diamines disclosed in U.S. Pat. No. 4,265,990. Also, there can be selected as photogenerating pigments squaraine compounds, thiapyrillium materials, and the like. These layered members are conventionally charged negatively thus requiring a positively charged toner. Moreover, the developer compositions of the present invention are particularly useful in electrostatographic imaging processes and apparatuses wherein there are selected a moving transporting means and a moving charging means; and wherein there is selected a deflected flexible layered imaging member, reference U.S. Pat. Nos. 4,394,429 and 4,368,970, the disclosures of which are totally incorporated herein by reference.

Images obtained with the developers composition of the present invention exhibit acceptable solids, excellent halftones and desirable line resolution with acceptable or substantially no background deposits.

The carrier of the invention is thus ideally suited for use in electrostatographic printing operations, in particular electrostatographic printing operations using a magnetic brush development system to develop a latent image formed on a photoreceptor.

The carrier of the invention is formed by powder coating, and thus avoids the problems discussed above with carriers formed by solution coating.

The invention will now be further explained by way of the following examples.

EXAMPLE 1

In this example, the amount of polyvinylidenefluoride (Kynar 301F) is 25 percent by weight of the total polymer coating, the remainder of the polymer coating comprising a polymer of PMMA containing 19 percent by weight of carbon black. The carrier is formed by the powder coating technique discussed above, the coating being applied so as to provide a coating weight of 0.6%. The carrier in this example preferably possesses the following properties:

(1) a conductivity of from about $1.0\times10^{-7}$ to $1.0\times10^{-9}$ $(\text{mho-cm})^{-1}$, more preferably $1.0\times10^{-8}$ $(\text{mho-cm})^{-1}$;

(2) a breakdown voltage of 30 to 50 V, more preferably 40 V;

(3) a mass flow of from about 1.3 to 1.8 g/sec, more preferably 1.6 g/sec;

(4) a bulk density of from about 2.1 to 2.7 g/cm$^3$, more preferably 2.4 g/cm$^3$;

(5) a particle size of from about 65 to 75 microns, more preferably 70 microns.

The coated carrier is incorporated into a toner to form a developer. The toner used is DC550 Toner from Fuji Xerox. The toner concentration of the developer is 4.0 parts of toner per one hundred parts of carrier. The triboelectric charge of this developer is 13 microcoulombs per gram. The developer is then used to develop latent images using a Hewlett Packard D640 printer. For each print test, the transferred mass of toner per unit area (TMA) is measured at 750 prints, and the solid area density (SAD) is measured at the beginning of 20% area coverage (450 prints), the beginning of 80% area coverage (750 prints), and the end of 80% area coverage (800 prints).

The results are as follows:

| | INVENTION |
|---|---|
| TMA | 0.8 |
| SAD @ 20% AC | 1.47 |
| SAD @ B80% AC | 1.45 |
| SAD @ E80% AC | 1.48 |

EXAMPLE 2

In this example, the amount of polyvinylidenefluoride (Kynar 301F) is 15 percent by weight of the total polymer coating, the remainder of the polymer coating comprising a polymer of PMMA containing 19 percent by weight of carbon black. The carrier is formed by the powder coating technique discussed above, the coating being applied so as to provide a coating weight of 0.6%. The carrier in this example preferably possesses the following properties:

(1) a conductivity of from about $2.0\times10^{-6}$ to $2.0\times10^{-8}$ $(\text{mho-cm})^{-1}$, more preferably $2.0\times10^{-7}$ $(\text{mho-cm})^{-1}$;

(2) a breakdown voltage of 35 to 55 V, more preferably 45 V;

(3) a mass flow of from about 1.3 to 1.8 g/sec, more preferably 1.6 g/sec;

(4) a bulk density of from about 2.1 to 2.7 g/cm$^3$, more preferably 2.40 g/cm$^3$;

(5) a particle size of from about 65 to 75 microns, more preferably 70 microns.

The coated carrier is incorporated into a toner to form a developer. The toner composition is prepared by extrusion melt-mixing 87 percent by weight of a 37 percent by weight gel content partially crosslinked polyester resin, reference U.S. Pat. No. 5,376,494, the disclosure of which is totally incorporated herein by reference, obtained by the reactive extrusion of a linear polyester, 5 percent by weight of carbon black, 5 percent by weight of a polypropylene wax, 660P low molecular weight wax available from Sanyo Chemicals, and 3 percent by weight of a compatibilizing agent comprised of the grafted copolymer KRATON™ obtained from Shell Chemicals. This mixture is ground and subsequently size classified to a volume median diameter of 9.0 microns by standard methods known in the art, and then a surface additive set comprised of 0.24 percent zinc stearate obtained from Ferro Corporation, 3.52 percent of a hydrophobic silica obtained from Nippon Aerosil Corporation and 0.85 percent of an organosilane-treated titania obtained from Tayca Corporation is blended onto the toner surface by standard methods known in the art. The toner concentration of the developer is 4.0 parts of toner per one hundred parts of carrier.

The coated carrier is incorporated into the toner to form a developer. The toner concentration of the developer is 4.0 parts of toner per one hundred parts of carrier. The triboelectric charge of this developer is 20 microcoulombs per gram. The developer is then used to develop latent images using a Hewlett Packard D640 printer. For each print test, the transferred mass of toner per unit area (TMA) is measured at 750 prints, and the solid area density (SAD) is measured at the beginning of 20% area coverage (450 prints), the beginning of 80% area coverage (750 prints), and the end of 80% area coverage (800 prints).

The results are as follows:

| | INVENTION |
|---|---|
| TMA | 0.71 |
| SAD @ 20% AC | 1.44 |
| SAD @ B80% AC | 1.47 |
| SAD @ E80% AC | 1.45 |

EXAMPLE 3

In this example, the amount of polyvinylidenefluoride (Kynar 301F) is 15 percent by weight of the total polymer coating, the amount of PMMA in the total polymer coating is 57 percent by weight and the remainder is a polymer comprised of PMMA containing 19 percent by weight of the carbon black. The carrier is formed by the powder coating technique discussed above, the coating being applied so as to provide a coating weight of 1.2%. The carrier in this example preferably possesses the following properties:

(1) a conductivity of from about $1.0\times10^{-12}$ to $1.0\times10^{-14}$ $(\text{mho-cm})^{-1}$, more preferably $1.0\times10^{-14}$ $(\text{mho-cm})^{-1}$;

(2) a breakdown voltage of 250 to 450 V, more preferably 350 V;

(3) a mass flow of from about 2.0 to 2.7 g/sec, more preferably 2.4 g/sec;

(4) a bulk density of from about 2.0 to 2.75 g/cm$^3$, more preferably 2.50 g/cm$^3$;

(5) a particle size of from about 67 to 77 microns, more preferably 72 microns.

The coated carrier is incorporated into a toner to form a developer. The toner composition is prepared by extrusion melt-mixing 87 percent by weight of a 37 percent by weight gel content partially crosslinked polyester resin, reference U.S. Pat. No. 5,376,494, the disclosure of which is totally incorporated herein by reference, obtained by the reactive extrusion of a linear polyester, 5 percent by weight of carbon black, 5 percent by weight of a polypropylene wax, 660P low molecular weight wax available from Sanyo Chemicals, and 3 percent by weight of a compatibilizing agent comprised of the grafted copolymer KRATON™ obtained from Shell Chemicals. This mixture was ground and subsequently size classified to a volume median diameter of 9.0 microns by standard methods known in the art, and then a surface additive set comprised of 0.6 percent zinc stearate obtained from Ferro Corporation, 1.73 percent of a hydrophobic silica obtained from Nippon Aerosil Corporation and 1.59 percent of an organosilane-treated titania obtained from Tayca Corporation is blended onto the toner surface by standard methods known in the art. The toner concentration of the developer is 4.0 parts of toner per one hundred parts of carrier. The coated carrier is incorporated into the toner to form a developer. The toner concentration of the developer is 4.0 parts of toner per one hundred parts of carrier. The triboelectric charge of this developer is 18 microcoulombs per gram. The developer is then used to develop latent images using a Hewlett Packard D640 printer. For each print test, the transferred mass of toner per unit area (TMA) is measured at 750 prints, and the solid area density (SAD) is measured at the beginning of 20% area coverage (450 prints), the beginning of 80% area coverage (750 prints), and the end of 80% area coverage (800 prints).

The results are as follows:

| | INVENTION |
|---|---|
| TMA | 0.66 |
| SAD @ 20% AC | 1.40 |
| SAD @ B80% AC | 1.39 |
| SAD @ E80% AC | 1.38 |

What is claimed is:

1. A coated carrier comprising a core particle coated with a mixture of an electronegative insulating polymer comprising a polyvinylidenefluoride polymer or copolymer and an electropositive conductive polymer comprising a polymethyl methacrylate polymer or copolymer having a conductive material dispersed therein, wherein the core particle has an average particle diameter of from 50 to 80 microns, a magnetic saturation of from 80 to 110 emu/g, a coercivity of from 20 to 30 Oer, and a retentivity of from 1.0 to 5.0 emu/g, and wherein the coated carrier has a conductivity of from $1.1\times10^{-14}$ to $1.0\times10^{-8}$ mho-cm$^{-1}$, a triboelectric charging value of from 12 to 20 and an average particle diameter of from 65 to 75 microns.

2. The coated carrier of claim 1, wherein the core particle is magnetite.

3. The coated carrier of claim 1, wherein the conductive material is carbon black.

4. The coated carrier of claim 3, wherein the carbon black is present in the polymethyl methacrylate polymer or copolymer in an amount of from 10 to 30% by weight of the polymer or copolymer.

5. The coated carrier of claim 1, wherein the mixture of the electronegative insulating polymer and the electropositive polymer contains from 10 to 90% by weight of the electronegative insulating polymer and from 10 to 90% by weight of the electropositive polymer.

6. The coated carrier of claim 1, wherein the mixture of the negatively charging polymer and the conductive polymer comprises 0.05 to 10% by weight of the coated carrier.

7. The coated carrier of claim 1, wherein the coated carrier further has a particle size distribution such that 90% of the particles have a diameter greater than 51 microns, 50% of the particles have a diameter greater than 70 microns, 10% of the particles have a diameter greater than 98 microns, and the minimum particle diameter is 30 microns.

8. The coated carrier of claim 1, wherein the coated carrier further has a bulk density of from 1.85 to 2.75 and a mass flow of from 1.25 to 1.85.

9. The coated carrier of claim 1, wherein the coated carrier has a conductivity of from $1.1\times10^{-14}$ to $1.1\times10^{-13}$ and a triboelectric charging value of from 16 to 19.

10. The coated carrier of claim 1, wherein the coated carrier has a breakdown voltage of 30 to 350 V.

11. A method of making a coated carrier comprising a core particle coated with a mixture of a negatively charging polymer comprising a polyvinylidenefluoride polymer or copolymer and a conductive polymer comprising a polymethyl methacrylate polymer or copolymer having a conductive material dispersed therein, wherein the core particle has an average particle size of from 50 to 80 microns, a magnetic saturation of from 80 to 110 emu/g, a coercivity of from 20 to 30 Oer, and a retentivity of from 1.0 to 5.0 emu/g, and wherein the coated carrier has a conductivity of from $1.1\times10^{-14}$ to $1.0\times10^{-8}$ mho-cm$^{-1}$, a triboelectric charging value of from 12 to 20 and an average particle diameter of from 65 to 75 microns, the method comprising mixing the core particle and the mixture of negatively charging polymer and conductive polymer until the mixture of negatively charging polymer and conductive polymer adheres to the core particle, thereafter heating the mixture of the core particle and the mixture of negatively charging polymer and conductive polymer until the mixture of negatively charging polymer and conductive polymer melts and fuses to the core particle, and subsequently cooling the coated core obtained.

12. The method according to claim 11, wherein the mixing is by mechanical impaction or electrostatic attraction.

13. The method according to claim 11, wherein the heating is at a temperature of from 320 to 550° F. for 10 to 60 minutes.

14. The method according to claim 11, wherein the mixture of the negatively charging polymer and the conductive polymer contains from 10 to 90% by weight of the negatively charging polymer and from 10 to 90% by weight of the conductive polymer.

15. A developer for a printing machine comprising toner and the coated carrier of claim 1.

* * * * *